United States Patent [19]

Farnsworth et al.

[11] Patent Number: 4,850,335

[45] Date of Patent: Jul. 25, 1989

[54] VENTED GAS RANGE TOP BURNER

[75] Inventors: Craig A. Farnsworth, Chagrin Falls; Alice Waters, South Euclid, both of Ohio

[73] Assignee: Gas Research Institute, Chicago, Ill.

[21] Appl. No.: 281,087

[22] Filed: Dec. 7, 1988

[51] Int. Cl.[4] ..... F24C 15/20

[52] U.S. Cl. ..... 126/299 R; 126/21 A; 126/39 R; 126/41 R; 126/300; 98/115.1

[58] Field of Search ..... 126/21 R, 21 A, 299 R, 126/299 D, 299 C, 300–303, 39 R, 39 K, 41 R, 80, 39 E, 39 H, 39 B, 39 G; 98/115.1; 99/446, 400; 55/DIG. 36

[56] References Cited

U.S. PATENT DOCUMENTS

| | | | |
|---|---|---|---|
| 1,582,634 | 4/1926 | Caldwell | 126/39 R |
| 3,002,513 | 10/1961 | Morasch | 126/299 R |
| 3,799,142 | 3/1974 | Jensen | 126/39 R |
| 4,335,705 | 6/1982 | Kiyomitu | 126/299 R |
| 4,457,293 | 7/1984 | Berlik | 126/39 N |
| 4,569,328 | 2/1986 | Shukla et al. | 126/39 J |
| 4,603,684 | 8/1986 | Kazuo et al. | 126/299 R |
| 4,616,626 | 10/1986 | Kwan Soon | 126/39 K |
| 4,648,378 | 3/1987 | Nishikawa | 126/21 A |
| 4,736,729 | 4/1988 | Beach | 126/39 R |
| 4,796,601 | 1/1989 | Yamada | 126/299 R |

*Primary Examiner*—James C. Yeung

*Attorney, Agent, or Firm*—Pearne, Gordon, McCoy & Granger

[57] ABSTRACT

A top burner for a gas cooking range includes a burner vent having a radially upwardly sloping wall surrounding the burner head. An annular ring projects upwardly from an inner radial extremity of the wall to direct combustion products from the burner head into immediate scrubbing contact with the bottom of a cooking utensil. The wall terminates at an outer radial extremity adapted to be located in sufficiently close proximity with the bottom of the cooking utensil to restrict radially outward flow of combustion products. Capture ports adjacent the outer radial extremity of the wall exhaust combustion products through a vent pipe to the atmosphere at a positive pressure. A range oven/broiler may also be connected to the vent pipe to provide a fully vented range.

15 Claims, 3 Drawing Sheets

VENTED GAS RANGE TOP BURNER

This invention relates generally to the field of gas cooking appliances and more particularly to ventilation of flue gas or combustion products from gas range top burners which provide a flame and/or combustion products for direct contact with a cooking utensil. This invention also relates to fully vented cooking appliances wherein oven and/or broiler burners thereof are commonly vented with the top burners.

The improved ventilation of gas ranges by removal of substantially all combustion products from the indoor environment is of increased concern due to the advent of tighter housing. Such improved ventilation of gas ranges will enhance the indoor air quality and reduce the space conditioning load of the house or indoor environment.

Canopy hoods are commonly used to vent gas range combustion products, but they are not entirely satisfactory and impose significant structural and design considerations due to their space requirements.

A stove top burner ventilation arrangement including an annular collector ring providing a chamber surrounding the burner head for receiving combustion products is disclosed in U.S. Pat. No. 3,799,142. As described in this patent, the collector ring is connected to a blower exhausted annular plenum chamber. The collector ring is spaced above the plenum chamber to allow the inward radial flow of ambient air into the space between the burner and the bottom of the cooking utensil.

U.S. Pat. No. 1,582,634 describes a top burner for commercial stoves wherein each burner comprises a circular array of combustion chambers having individually controllable supplies of fuel gas. The combustion products in each of the chambers are withdrawn downwardly into an annular chamber and subsequently discharged through a flue.

Another ventilation system for individual gas top burners is disclosed in U.S. Pat. No. 3,002,513. In this patent, a pair of spaced hemispherical bowls provide a vent space therebetween for exhausting cooking odors and heat with the aid of a blower. The vent space is normally closed by a pivotal flap located radially outboard of the cooking utensil support grate.

A tabletop cooker having a burner and overhead frying pan or roaster recessed in a tabletop is disclosed in U.S. Pat. No. 4,616,626. The roaster includes a round dome portion having openings for discharge of burner combustion products to a second set of openings in a surrounding wall of the table recess and subsequent ventilation through a collection chamber by an exhaust fan.

Conventional surface down draft ventilation systems used in connection with surface ranges having top burners and a surface grill are shown in U.S. Pat. Nos. 4,457,293 and 4,736,729. In such patents, a surface vent is disposed between the burners and grill for exhausting cooking byproducts through a vent pipe using a blower.

In accordance with the foregoing prior art devices and techniques, thermal efficiency is generally reduced with increased capture of combustion products. More particularly, canopy hoods typically are of increasing effectiveness with increasing exhaust air flows which cause some decrease in the thermal efficiency of the burner and increase in the space conditioning load and sound level in the kitchen. In down draft systems and techniques, increased capture of combustion products has heretofore also been associated with decreases in thermal efficiency and such is believed to be related to the loss of heating of the cooking utensil sidewall by the rising combustion products.

SUMMARY OF THE INVENTION

In accordance with the invention, effective ventilation or capture of combustion products of gas range top burners is provided with high thermal efficiencies. The ventilation of the top burners may be modified to also vent associated oven and/or broiler burners to provide a fully vented range. In either case, the use of a canopy hood is optional.

A burner vent or cone grate provided in accordance with the invention enhances heat transfer by inducing scrubbing flow of the combustion products along the bottom of the cooking utensil prior to venting. The improved heat transfer to the bottom of the utensil is believed to provide improved thermal efficiency even though heating of the sidewall of the utensil is substantially eliminated.

The burner vent tends to confine the flow of combustion products against and along the bottom of the utensil in order to enhance both the intensity and the extent of scrubbing. More particularly, the combustion products are caused to flow directly from the burner head into engagement with the utensil bottom and to travel radially outwardly therealong as an accelerating scrubbing flow of gas prior to capture.

The burner vent includes a gas flow directing surface which surrounds the burner head and extends radially upwardly along the major portions thereof to confine and accelerate the flow of combustion products along the bottom of the cooking utensil. The gas flow directing surface includes an inner peripheral surface portion adjacent the burner head for causing immediate upward gas flow to the utensil bottom and an outer peripheral surface portion for restricting radial gas flow. In this manner, the coefficient of heat transfer is increased by the relatively more vigorous scrubbing flow intensity and the area of scrubbing flow is increased. Further, it is believed that the gas flow directing surface also maintains an insulating layer of hot combustion gases below the primary scrubbing flow of gases adjacent the bottom of the utensil.

The burner vent may be arranged to project from a top surface of the gas range for use with standard finger grates which extend upwardly from the range surface. Alternatively, the burner vent may be arranged to utilize support grates which are substantially flush with the top surface of the range. In the latter case, the support grate may be supported in a recess in the top surface of the range. In addition to an aesthetically more pleasing appearance, the flush support grate also provides greater stability since the cooking utensil is supported at substantially the same height as the top surface of the range and facilitates removal of a cooking utensil from the support grate to the top surface of the range.

In the illustrated embodiments, the burner vent comprises an inverted cone-shaped wall having a central opening for the burner head. An annular surface projects upwardly from the inner radial extremities of the cone-shaped wall to direct flames and/or combustion products upwardly toward a central location on the bottom of the cooking utensil. The outer radial extremities of the cone-shape wall are positioned in sufficiently close proximity with the bottom of the cooking utensil to restrict radial gas flow. Capture ports for receiving the combustion products extend through the cone-shaped wall adjacent its outer radial extremities and communicate with an annular exhaust manifold arranged to discharge the combustion products through a vent pipe to the atmosphere at a positive pressure.

In accordance with the invention, the top burners are effectively vented by capture and positive venting of more than 80%, and more preferably, more than 90% of the combustion products. Accordingly, gas range installation is facilitated since hood requirements may be eliminated. In view of the high percent of capture of top burner combustion products, hood requirements are substantially no different from those applicable to an electric range.

DETAILED DESCRIPTION OF THE DRAWINGS

Figure 1:
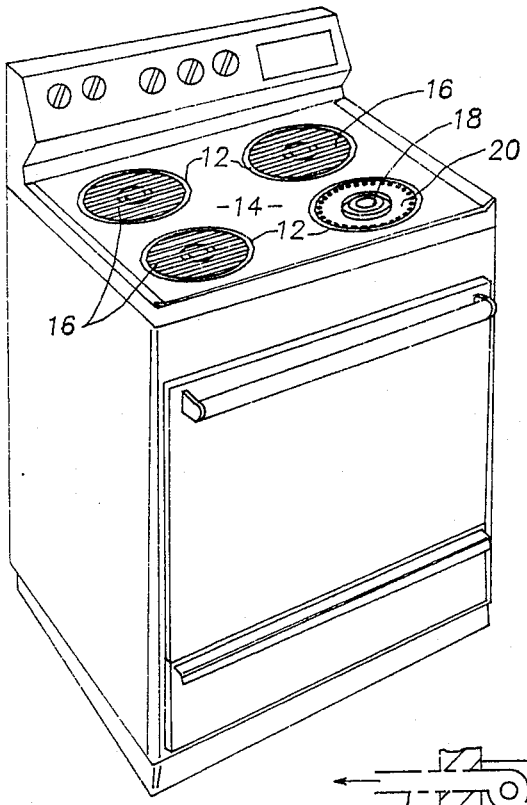
FIG. 1 is a perspective view of a gas cooking range having vented top burners in accordance with the invention.
Figure 2:
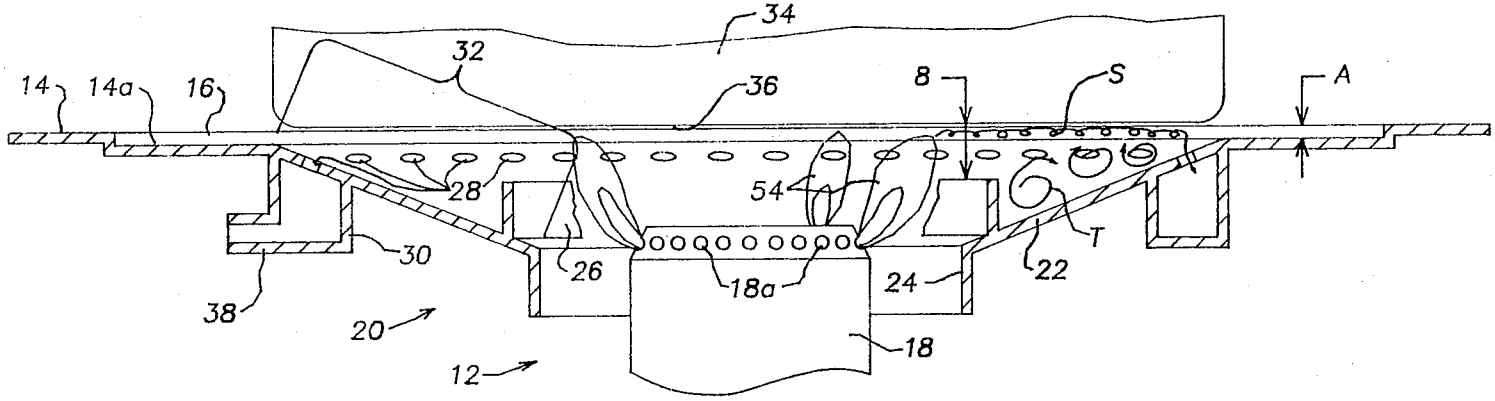
FIG. 2 is a sectional view of one of the top burners shown in FIG. 1 with parts broken away and omitted for clarity of illustration.

Referring to FIGS. 1 and 2, there is shown a gas cooking range 10 having four blue-flame atmospheric top burners 12 mounted in its top surface 14. The top burners 12 are arranged for use with support grates 16 which are substantially flush with the top surface 14 of the range 10 as described more fully below. As shown in FIG. 1, one of the support grates 16 is omitted to expose burner head 18 and associated burner vent or cone grate 20.

As shown in FIG. 2, the burner vent 20 comprises an inverted cone-shaped wall 22 having a central opening 24 surrounding the burner head 18, an annular ring 26, a plurality of capture ports 28 and an exhaust manifold 30 communicating with the capture ports 28 for venting the combustion products to the atmosphere. The wall 22 and ring 26 cooperate to provide a gas flow directing surface 32. The opening 24 is sized to allow a sufficient upward flow of secondary air for combustion by the burner head 18 in the same manner as the central opening in a conventional aeration bowl. For example, a conventional burner head has a diameter of about 2¼" and the surrounding aeration bowl opening has a diameter of about 3-15/16".

A cooking utensil 34 having a bottom or lower wall 36 is positioned on the support grate 16 for heating by the burner 12. The burner head 18 is mounted in the range 10 so that the top surface 14 is about 15/16" above the burner head. Therefore, the conventional 15/16" spacing between the burner head and bottom wall of the cooking utensil is maintained in the range 10.

The cone-shaped wall 22 may be integrally formed with the upper wall of the range 10 which provides the top surface 14 as shown in FIG. 2. Alternatively, the cone-shaped wall 22 may be separately formed of a suitable metal material and mounted to the range 10.

The overall lateral dimensions of the burner vent 20 and/or radial extent of the wall 22 are selected to correspond with the width of the bottom wall of a typical cooking utensil such as the bottom wall 36 of the utensil 34. For example, the use of a burner vent having a 9" overall lateral or radial size has been found to provide satisfactory capture of combustion products and thermal efficiency for most larger sized cooking utensils.

The overall lateral dimensions and configuration of the burner 20 are selected so that the outer radial extremity of the surface 32 substantially restricts the continued radial outward flow of the combustion products. Accordingly, the combustion products are vented through the ports 28. In order to radially restrict the flow of combustion products and cause venting through ports 28, the clearance distance or gap between the lower surface of the bottom wall 36 and the adjacent portion of the surface 32, as indicated at "A" in FIG. 2, should be about ¼" or less, and preferably, about ⅛".

The increases in thermal efficiency achieved with the use of the indicated clearance gap are believed to result from more intense scrubbing of the bottom wall 36 by the combustion products, maximization of the relative amount of gas in the region intermediate the wall 36 and surface 32, and maintenance of relatively higher gas temperatures. If the size of gap "A" is further reduced, the additional increases in thermal efficiency are accompanied by increasing levels of incomplete combustion.

The desired distance "A" may be provided in a typical gas cooking range by arranging the wall 22 at an upwardly slope of about 20° or more. The use of a slope which is less than 20° tends to result in incomplete combustion. For most conventional ranges, geometry considerations limit the maximum slopes of the wall 22 to about 30°.

The illustrated support grate 16 has a total thickness of about ⅛", and it is mounted in a ⅛" deep recess 14*a* in the top surface 14 of the range 10. The illustrated support grate 16 is formed of rod stock of a suitable material such as heat and corrosion resistant stainless steel.

The annular ring 26 is sized to direct the flame and combustion products from the burner head 18 immediately to the lower surface of the bottom wall 36 of the utensil 34. The ring 26 is sized to avoid chilling of the flame which results in incomplete combustion and/or blocking of the flow of combustion products. Satisfactory results have been obtained when the ring 26 is provided with a diameter of about 4½" and a height such that the clearance "B" between the top of the ring and the bottom wall 36 is in the range of from about ⅜" to about ½".

The capture ports 28 are evenly spaced about the entire periphery of the burner vent 20. The capture ports 28 may be of a single size, for example ⅜", or mixed sizes such as an alternating pattern of ¼" and ⅜" diameter openings. A sufficient number of ports 28 should be used in order to cause substantially uniform radially outward flow of the combustion products from the burner head 18. The total area of the ports 28 for each burner 12 may be in the range of 1 to 4 in.$^2$, and more preferably, about $2\pm\frac{1}{4}$ in.$^2$. With such sizing, an exhaust flow of 5 to 9 CFM may be provided from each burner 12 through its associated exhaust manifold 30 with achievement of the desired confinement of combustion products against the bottom wall 36 and scrubbing and turbulent flows.

Figure 3:
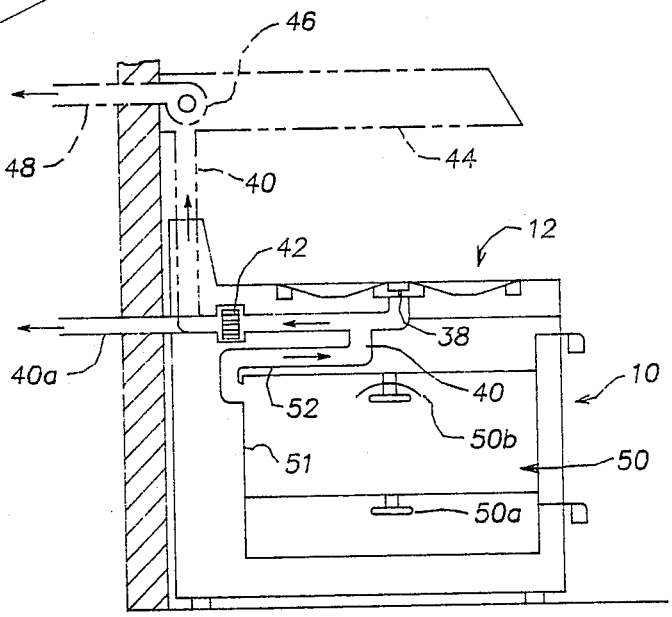
FIG. 3 is a diagrammatic sectional view of the range shown in FIG. 1 with parts broken away and omitted for clarity of illustration.

The exhaust manifold 30 has a generally circular configuration with the ports 28 extending through the wall 22 in fluid communication with the manifold 30. The exhaust manifold 30 is connected by a duct 38 to a common vent pipe 40 as shown in FIG. 3. A blower 42 is mounted in the vent pipe 40 for maintaining a negative pressure in the exhaust manifold 30 and causing discharging of the combustion products to the atmosphere through an open end 40*a* of the vent pipe 40.

As shown in phantom outline in FIG. 3, the vent pipe 40 may be arranged for discharge through a range hood or canopy 44. The hood 44 includes a blower 46 and a vent pipe 48 for discharge to the atmosphere of gas from the vent pipe 40 and exhausting the region above the top of the range 10. The hood 44 is otherwise of conventional design and operation.

As shown in FIG. 3, the range 10 also includes a combination oven/broiler 50 which is commonly vented with the top burners 12. In the illustrated embodiment, the oven/broiler 50 has a common cooking chamber 51, an oven burner 50*a* and a broiler burner 50*b*. Accordingly, a vent pipe 52 connects the cooking chamber 51 to the vent pipe 40. As described above, the oven/broiler 50 may be vented directly through the vent pipe 40 or optionally through the vent pipe 48 when the range 10 is equipped with a hood 44. Ranges having separate oven and broiler chambers may also be commonly vented with the top burners.

Referring to the right-hand side of FIG. 2, operation of the top burner 12 is illustrated with reference to the flamelets 54 (only two being shown) emerging from the burner head ports 18*a*. The adjacent portion of the surface 32 including that provided by the ring 26 direct the flamelets 54 or combustion products from the burner head 18 into immediate contact with the lower surface of the bottom wall 36 of the utensil 34. More particularly, the flamelets or combustion products are directed as close to the center of bottom wall 36 as is possible without causing chilling of the flame or otherwise deleteriously affecting the combustion process. A high velocity scrubbing flow of hot combustion products indicated at "S" in FIG. 2 is established along the lower surface of the bottom wall 36 extending from the inner to the outer radial extremities of the surface 32 prior to venting through the ports 28. At the same time, it is believed that a turbulent flow of combustion products indicated at "T" in FIG. 2 is established intermediate the surface 32 and the scrubbing flow "S" of combustion products. Accordingly, the surface 32 of the wall 22 cooperates with the bottom wall 36 of the cooking utensil 34 to define a flow passageway of decreasing dimension in a radially outward direction which is sized and arranged to cause the accelerating scrubbing flow "S" of combustion products along the bottom wall 36 and adjacent turbulent flow "T" of combustion products.

Figure 4:
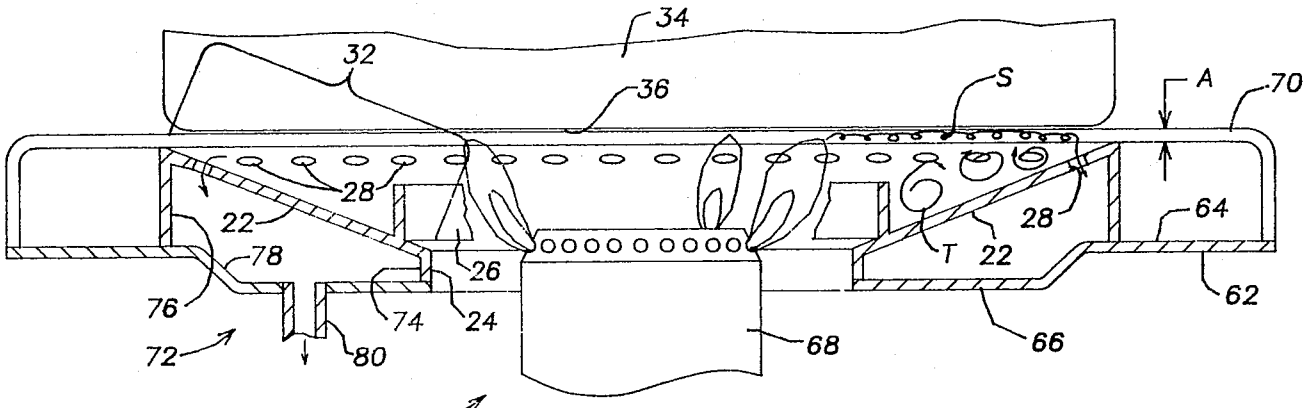
FIG. 4 is a sectional view similar to FIG. 2 showing another embodiment of a top burner in accordance with the invention.

Referring to FIG. 4, a top burner 60 is shown. The top burner 60 is designed for use in a gas cooking range 62 having a conventional top surface 64 including an aeration bowl 66 surrounding each burner head 68 and finger or support grates 70 extending upwardly from the top surface 64. The top burner 60 includes a modified burner vent or cone grate 72 which extends above the top surface 64. Accordingly, it is not necessary to modify the tooling for the manufacture of the top surface 64. In the further description of this embodiment, elements having substantially the same structure as in the first embodiment are similarly numbered.

The burner vent or cone grate 72 has an inverted cone-shaped wall 22 and concentric inner and outer axially extending walls 74 and 76. Thus, the burner vent 72 may be separately constructed and fixed to the top surface 64 by welding or other suitable manner.

The burner vent 72 also includes a central opening 24, an annular ring 26 and capture ports 28. In this embodiment, an exhaust manifold 78 may be provided by the interior adjacent surfaces of the walls 22, 74 and 76 together with the adjacent portion of the top surface of the aeration bowl 66. The combustion products are removed from the manifold 78 by a duct 80 which may be connected to vent pipe 40.

The top burner 60 operates in the same manner as the top burner 12 described above. To that end, the wall 22 and the ring 26 cooperate to provide gas flow directing surface 32 which maximizes the extent and intensity of the scrubbing flow of combustion products along the bottom wall 36 of the cooking utensil 34.

Figure 5:
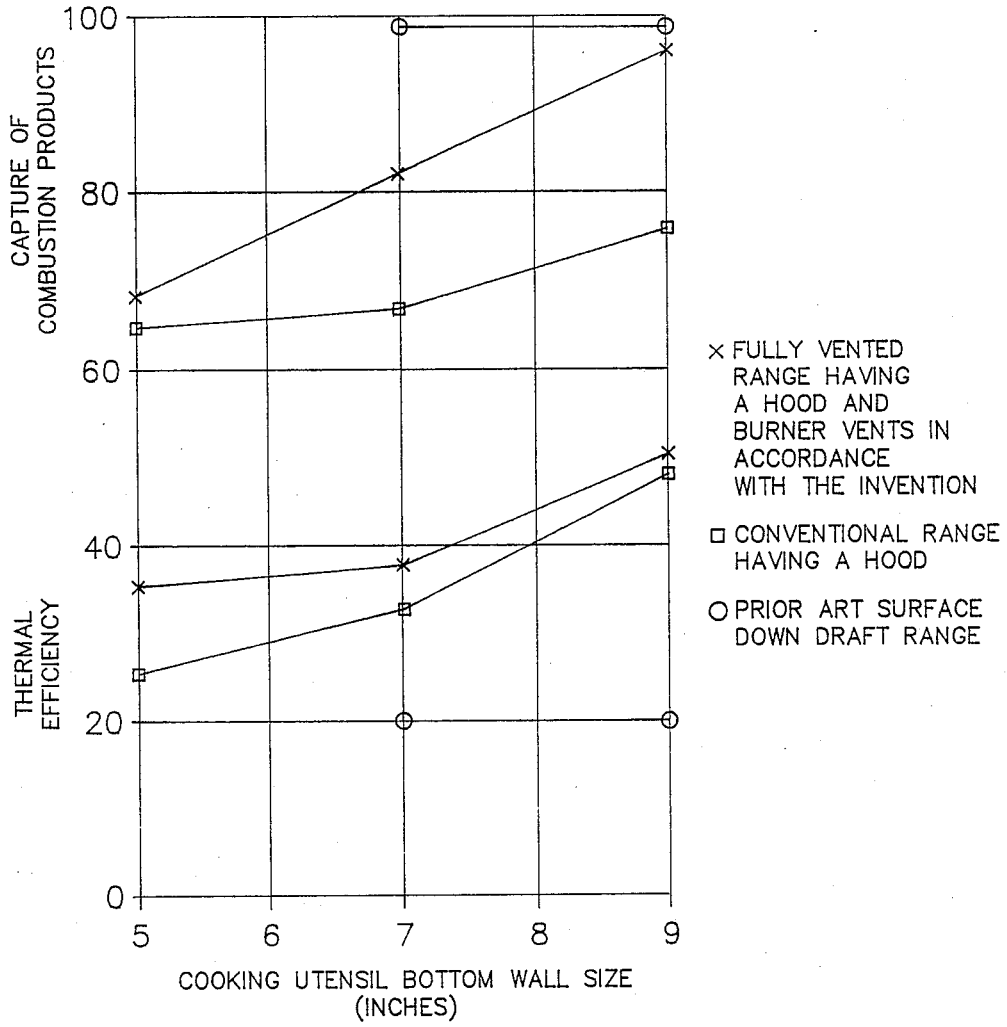
FIG. 5 is a graph showing the relationship of efficiency of capture of combustion products and thermal efficiency with utensil size.

Referring to FIG. 5, capture of combustion products and thermal efficiency for various size cooking utensils are compared for a range having a hood and burner vents in accordance with the invention, a conventional range having a hood, and a prior art surface down draft range as described in U.S. Pat. Nos. 4,457,293 and 4,736,729. The comparison is based upon operation of the two front top burners only.

The capture of combustion products was determined by measurement of $No_x$ concentrations at selected test locations in a chamber containing the range and comparing such with the $NO_x$ concentration in a vent gas stream from the chamber with adjustment for ambient concentrations. The thermal efficiency is based upon the rate of vaporization of water from open pots of water of the indicated sizes as compared with the energy input rate to the burners.

As compared with a conventional range having a hood, a range having burner vents in accordance with the invention achieves slightly higher efficiencies and a significantly improved capture of combustion products. More particularly, the percent capture is increased from about 66% to about 82% for the 7" cooking utensil and from about 75% to about 96% for the 9" cooking utensil.

The prior art surface down draft range effectively captures combustion products but only with an unacceptable heating efficiency. More particularly, the heating efficiency is about 20% for both the 7" and 9" cooking utensils. Accordingly, the prior art surface down draft range is not considered to be an acceptable alternative.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not limited in scope and effect to the specific embodiments herein shown and described nor in any other way that is inconsistent with the extent to which the progress in the art has been advanced by the invention.

What is claimed:

1. A gas range top burner comprising a burner head for combustion of fuel gas and air to provide combustion products for heating a cooking utensil having a bottom extending over the burner head, burner vent means including a gas flow directing surface surrounding the burner head and extending radially from an inner radial extremity adjacent the burner head to an outer radial extremity remote of the burner head for confining the flow of combustion products adjacent the bottom of the cooking utensil, inner gas flow means located adjacent said inner radial extremity of the surface for directing combustion products from said burner head upwardly, outer gas flow means located adjacent said outer radial extremity of the surface for substantially restricting radial flow of combustion products, ports adjacent said outer radial extremity of said surface for receiving and venting combustion products, and exhaust means in fluid communication with said ports for remote discharge of said combustion products to the atmosphere at a positive pressure, said inner and outer gas flow means cooperating to induce scrubbing flow of combustion products along the bottom of the cooking utensil prior to venting through said ports and exhaust means.

2. A gas range top burner according to claim 1, wherein said gas flow directing surface slopes upwardly from said inner radial extremity to said outer radial extremity.

3. A gas range top burner according to claim 2, wherein said inner gas flow means comprise an inner peripheral surface portion projecting from said gas flow directing surface and surrounding said burner head.

4. A gas range top burner according to claim 3, wherein said outer gas flow means comprise an outer peripheral surface portion of said surface adapted to be located in gas flow restricting relationship with the bottom of the cooking utensil.

5. A gas range top burner according to claim 4, wherein said ports comprise openings extending through said gas flow directing surface adjacent said outer radial extremity.

6. A gas range top burner according to claim 5, wherein said exhaust means include a manifold below said gas flow directing surface, said openings communicating with said manifold and said manifold communicating with a vent pipe connected to blower means and having an end open to the atmosphere for discharge of said combustion products.

7. A gas range top burner according to claim 6, wherein said gas flow directing surface has an inverted cone shape along major portions thereof with a central opening for receiving said burner head.

8. A gas range top burner according to claim 7, wherein said inner peripheral surface portion comprises an annular wall extending upwardly from said gas flow directing surface.

9. A gas range top burner according to claim 8, wherein a support grate is provided for supporting the cooking utensil, and said grate and burner vent means are arranged to provide a clearance space equal to from about $\frac{1}{4}''$ to about $\frac{1}{8}''$ between the bottom of the cooking utensil and the outer peripheral surface portion of the burner vent.

10. A gas range having a top surface extending substantially in a flat plane and including at least one top burner according to claim 1 mounted in the top surface, a support grate for supporting the cooking utensil about the burner head, said support grate being located substantially in the plane of said top surface.

11. A gas range according to claim 10, wherein said top surface includes a recess for receiving said support grate.

12. A gas range according to claim 11, wherein said support grate comprises a plurality of rod members arranged in a substantially flat planar array.

13. A gas range having at least one top burner according to claim 1 and an oven including an oven vent connected to said exhaust means.

14. A gas range according to claim 13, including a broiler having a broiler vent connected to exhaust means.

15. A gas range top burner comprising a burner head for combustion of fuel gas and air to provide combustion products for heating a cooking utensil having a bottom extending over the burner head, burner vent means including a gas flow directing surface surrounding the burner head and extending radially from an inner radial extremity adjacent the burner head to an outer radial extremity remote of the burner head for confining the flow of combustion products adjacent the bottom of the cooking utensil, an inner annular surface portion projecting upwardly from said surface adjacent the inner radial extremity thereof and surrounding said burner head for directing combustion products from said burner head upwardly, an outer peripheral surface portion of said surface located adjacent said outer radial extremity thereof and arranged to be located in sufficiently close proximity with the bottom of the cooking utensil to substantially restrict radial flow of combustion products, ports adjacent said outer radial extremity of said surface for receiving and venting combustion products, and exhaust means in fluid communication with said ports for remote discharge of said combustion products to the atmosphere at a positive pressure, said burner vent means venting through said ports and exhaust means at least about 80% of the combustion products provided by said burner head and said inner annular surface portion and outer peripheral surface portion cooperating to induce scrubbing flow of combustion products along the bottom of the cooking utensil prior to venting through said ports and exhaust means whereby said top burner's thermal efficiency of heating said cooking utensil is at least equal to that of a similar top burner not including burner vent means and flowing combustion products upwardly along the cooking utensil sidewall.

* * * * *